United States Patent [19]

Post et al.

[11] 4,445,970

[45] May 1, 1984

[54] HIGH MINERAL COMPOSITE FINE PAPER

[75] Inventors: Richard L. Post, Ridgway; Robert G. Fort, St. Marys, both of Pa.

[73] Assignee: Penntech Papers, Inc., White Plains, N.Y.

[21] Appl. No.: 267,941

[22] Filed: Jun. 1, 1981

Related U.S. Application Data

[63] Continuation-in-part of Ser. No. 199,165, Oct. 22, 1980, abandoned.

[51] Int. Cl.[3] ..... D21F 11/00

[52] U.S. Cl. ..... 162/135; 162/136; 162/164.6; 162/168.2; 162/168.3; 162/181.1; 162/181.2; 162/181.4; 162/181.6; 162/181.8

[58] Field of Search ..... 162/169, 183, 181.1, 162/168.1, 181.2, 175, 181.4, 135, 181.8, 136, 158, 164.1, 164.6, 168.2, 168.3, 181.6

[56] References Cited

U.S. PATENT DOCUMENTS

| | | | |
|---|---|---|---|
| 2,657,991 | 11/1953 | Walsh et al. | 162/169 |
| 3,119,731 | 1/1964 | Strole et al. | 162/183 |
| 3,844,880 | 10/1974 | Meisel et al. | 162/169 |
| 4,225,383 | 9/1980 | McReynolds | 162/169 |

FOREIGN PATENT DOCUMENTS

| | | | |
|---|---|---|---|
| 619559 | 5/1961 | Canada | 162/169 |
| 627550 | 9/1961 | Canada | 162/169 |
| 0006390 | 1/1980 | European Pat. Off. . | |

*Primary Examiner*—Peter Chin

*Attorney, Agent, or Firm*—Karl W. Flocks; Sheridan Neimark

[57] ABSTRACT

Composite fine paper suitable for offset and gravure printing at high speeds and containing over 30% filler up to 70% filler for basis weights of 30–150 lbs/3300 ft$^2$, is produced on a high speed paper-making machine from a furnish containing large quantities of filler, preferably a mixture of clay and talc, and including 3–7% of an ionic latex which is selected to provide good retention and good strength without leaving a residue on the screen.

28 Claims, 1 Drawing Figure

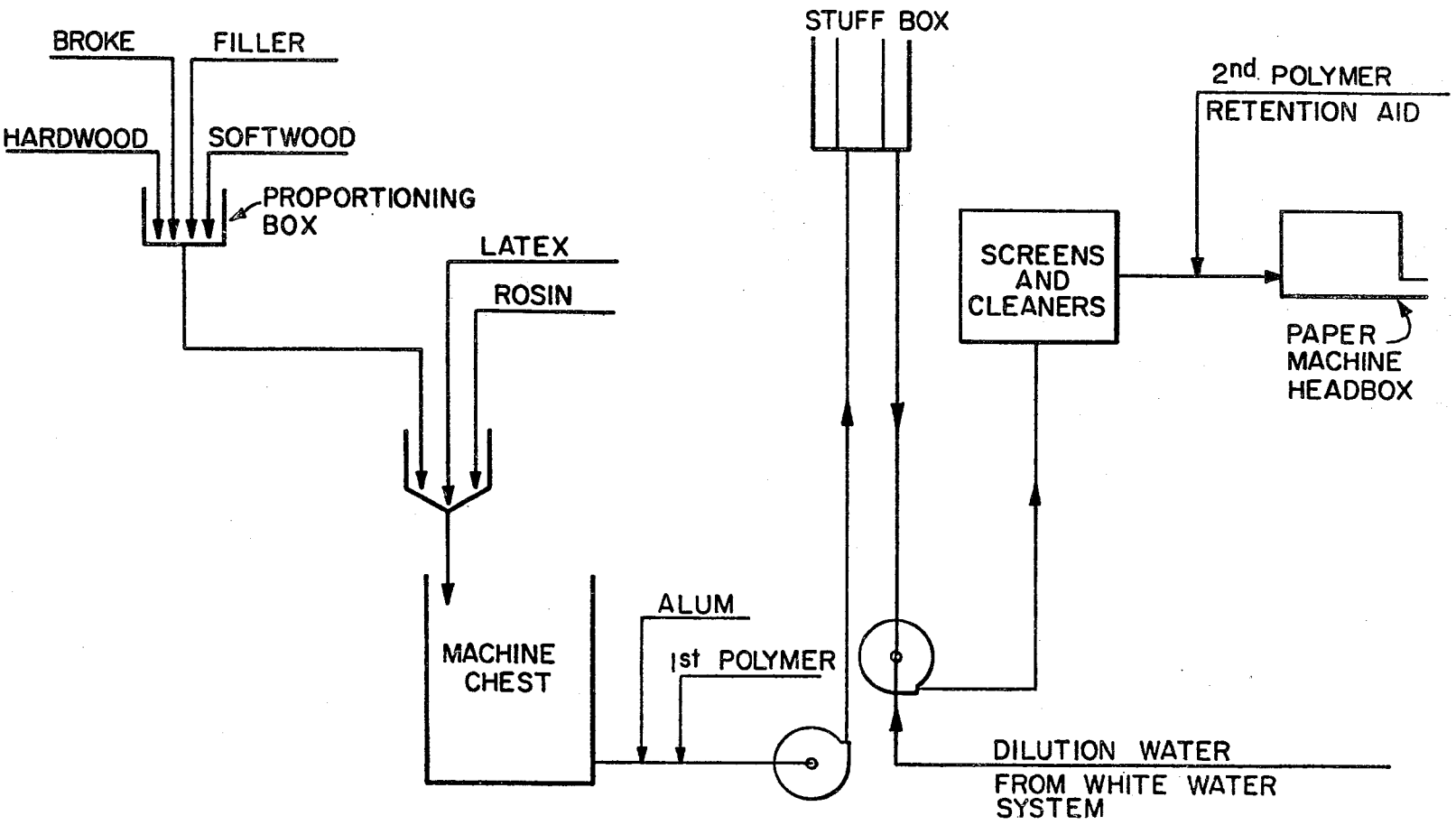
2nd POLYMER
RETENTION AID
PAPER MACHINE HEADBOX
SCREENS AND CLEANERS
DILUTION WATER
FROM WHITE WATER SYSTEM
STUFF BOX
ALUM
1st POLYMER
LATEX
ROSIN
MACHINE CHEST
PROPORTIONING BOX
FILLER
SOFTWOOD
BROKE
HARDWOOD

HIGH MINERAL COMPOSITE FINE PAPER

DESCRIPTION

FIELD OF INVENTION

This application is a continuation-in-part of patent application Ser. No. 199,165, filed Oct. 22, 1980 by Richard L. Post and Robert G. Fort, entitled "HIGH MINERAL COMPOSITE FINE PAPER" and now abandoned.

The present invention relates to offset or gravure printable fine paper and, more particularly, to highly mineral filled fine paper weighing from 30 to 150 lbs/3300 $ft^2$ and having sufficient strength to be usable for offset or gravure printing.

BACKGROUND OF THE INVENTION

Normal fine paper contains internally some filler up to a maximum of about 30% mineral filler. As fine paper suitable for offset and gravure printing must have sufficient strength to resist the printing operation which is carried out under high speed, and this includes both tensile and Z-direction strength, it has been found that the use of high quantities of mineral filler are not suitable. Indeed, the normal offset printable fine paper has a very low mineral filler content, and this paper is normally surface sized after the paper web has been dried. The term "fine" paper is used in the conventional industry sense and includes tablet, bond, offset, coated printing papers, text and cover stock, coated publication paper, book paper and cotton paper; it does not include so-called "high-strength" paper products.

The use of filler internally in the manufacture of paper in general and fine paper in particular has been practiced for many years using common fillers such as kaolin clay, talc, titanium dioxide, calcium carbonate, hydrated aluminum silicate, diatomaceous earth and other insoluble inorganic compounds. The use of filler accomplishes two objectives: one is the extension of the paper-making fibers to reduce cost and the other is to obtain certain optical and physical properties such as brightness and opacity. In fine paper manufacture, fillers are normally added at a level of 4–20% by weight of the finished paper, although rarely as much as 30% filler has been used in Europe and 25% in the United States. Fine paper manufacture in part depends on hydrogen bonding and one problem which occurs in the use of more than 20% filler in fine paper manufacture is that too much filler reduces hydrogen bonding and causes the web to lose its strength. Using external methods of application, such as coating with pigment/adhesive mixture on the size press or coater, the total filler content can easily be increased.

Fine paper containing up to a maximum of 30% filler is normally made by adding 15–20 pounds of cationic starch or 1–5 pounds of guar gum per ton of dry furnish, as normal internal strength agents. Latices are sometimes used in paper manufacture as noted below, but not in fine paper manufacture because such latices are normally sticky and difficult to use on a Fourdrinier machine for making fine paper at high speed.

The U.S. Pat. No. 3,184,373 to Arledter discloses the production of paper having greater than normal quantities of mineral fiber, but no mention is made of the properties of the resultant paper. The Arledter process depends on what is referred to as a synergistic mixture of filler retention aids, including a water soluble mucilaginous material, such as guar gum, and a water-soluble polyethylene imine resin. An earlier patent in the name of the same patentee, U.S. Pat. No. 2,943,013, contains similar subject matter, but the resultant paper is specified to be for use in the manufacture of decorative laminates, i.e. there is no requirement for the high strength necessary for fine papers which are to be printed by the offset method.

It has been common knowledge in the paper industry that the addition of an anionic latex to the wet end of a paper machine combined with a cationically charged chemical, such as alum, causes the latex to precipitate in the presence of the paper-making fibers and fillers and thereby gives the paper increased strength. This procedure is normally used in the manufacture of certain so-called "high-strength" products such as gasket material, saturated paperboard, roofing felt, flooring felt, etc. No similar technique has heretofore been suggested for the manufacture of fine paper having greater than normal quantities of mineral filler.

A number of prior patents disclose the general idea that a charged latex can be added to the paper-making furnish. Because of the basic electro-chemical reaction of an anionic paper-making system, a cationic latex precipitates easily and provides additional fiber bonding and, accordingly, strength to the resultant paper. These patents relate primarily to so-called "high-strength" papers which are largely devoid of fillers, or at best contain only very small quantities of fillers or pigments. For example, Wessling et al U.S. Pat. No. 4,178,205 discusses the use of a cationic latex, but pigment is not essential. Also the U.S. Pat. No. 4,187,142 to Pickleman et al discloses the use of an anionic polymer co-additive with a cationic latex, with the use of a sufficient amount of latex to make the entire paper-making system cationic; the use of fillers in any example is not mentioned. Foster et al U.S. Pat. No. 4,189,345 discusses extremely high levels of cationic latex.

It has been proposed noting the McReynolds U.S. Pat. No. 4,225,383, in the manufacture of relatively thick paper product, similarly to the manufacture of roofing and flooring felt papers, to use the combination of a cationic polymer with an anionic latex, and substantial quantities of mineral filler. Once again, however, the product is not designed for printing using the offset method, and its strength requirements are accordingly relatively low. Moreover, because of the substantial thickness of the products produced by such a technique, the product is given some additional strength merely by means of its mass.

The Riddell et al U.S. Pat. No. 4,181,567 is directed to the manufacture of paper using an agglomerate of ionic polymer and relatively large quantities of filler. The patentees indicate that either anionic or cationic polymers may be used, and fillers mentioned are calcium carbonate, clay, talc, titanium dioxide and mixtures. In example 1, an 80 basis weight paper having 29% ash is produced using calcium carbonate as the filler. This patent in essence discusses precipitation of the pigment with a retention aid system prior to its addition to the paper-making system.

Such Riddell et al patent mentions German Offenlegunschrift No. 25 16 097 near the bottom of column 1 thereof, the latter of which corresponds to U.K. Pat. No. 1,505,641 which discloses the pre-treatment of calcium carbonate with a styrene-butadiene latex to produce a protected pigment which can then be used in paper making preferably at the 20% by weight level, although the patent does state that there is little or no reduction in strength up to the 50% by weight level. In more detail, the U.K. patent discloses mixing an anionic latex with an aqueous suspension of the special filler having a cationic charge, e.g. made by mixing with positively charged starch. One to twenty parts of latex are used per 100 parts of filler, and the filler composition is added to the beater, pulper or elsewhere before the breast box. Example III shows the use of 400 parts of filler to 700 parts of wood fiber. A point to be emphasized, however, is that the technique of the U.K. patent requires extra equipment and extra processing, as the filler is first encapsulated and then only later added to the paper-making system; in other words, the technique of the U.K. patent is unduly complex. Moreover, the encapsulation provides inadequate protection to enable the calcium carbonate to be used in acidic medium without undesirable foaming.

SUMMARY OF THE INVENTION

It is, accordingly, an object of the instant invention to overcome deficiencies in the prior art, such as indicated above.

It is another object to provide fine paper suitable for use in offset printing, which paper contains more than normal quantities of mineral filler.

It is a further object to provide good quality, fine paper of thickness 1.5–15 mils, preferably 2–8 mils, and a weight of 0.009–0.945 lbs/ft$^2$, having adequate strength for offset printing and having a high mineral filler content ranging from about 30% filler for 30 pound paper (based on 3300 ft$^2$) to 70% filler for 70–150 pound paper.

It is yet another object of the invention to provide a process for making good-quality, fine printing paper containing large amounts of mineral filler, in an economical manner, at less cost, and at a higher production rate.

It is yet a further object to provide high mineral content paper of good quality containing a synergistic mixture of mineral fillers.

These and other objects and the nature and advantages of the instant invention will be more apparent from the following detailed description of various embodiments of the instant invention, taken in conjunction with the following drawing of an exemplary embodiment.

BRIEF DESCRIPTION OF THE DRAWING

The sole FIGURE is a schematic flow sheet showing a system, upstream of the paper-making machine, for preparing a paper-making furnish in accordance with the invention.

DETAILED DESCRIPTION OF EMBODIMENTS

Generally in accordance with the invention, fine paper of thickness 1.5–15 mils, preferably 2–8 mils, and weight $9\text{–}45\times10^{-3}$ lbs/ft$^2$, preferably $9\text{–}24\times10^{-3}$ lbs/ft$^2$, is produced containing from 30% mineral filler to 70% mineral filler, although it will be understood that the invention can be used in making other types of paper and that the filler range will depend on the ultimate use for which the paper is intended. However, for fine paper suitable for use in offset printing, 30% mineral filler will normally be used for 30 pound paper, 40% for 40 lbs, 50% for 50 lbs, 60% for 60 lbs and 70% mineral filler for 70–150, preferably 70–80, pound paper, all based on 3300 ft$^2$.

The fine paper is suitably produced on a conventional Fourdrinier paper machine at increased speeds with a major energy saving which permits production increases, although it will be understood that other types of paper-making equipment can also be used, e.g. cylinder machines, twin wires, etc. Because of the exceptional strength of the present paper-making system in relation to other high filler content fine paper systems, the paper machine runs better and the resultant fine paper can be used in general printing processes and functions as a bond paper.

The use of large quantities of mineral filler drastically reduces the cost of the fine paper manufacture. In the first place, there is provided a savings of $30–70 per ton in the materials from which the fine paper is made. This number will increase as fiber is much more costly than filler material and tends to increase in cost more rapidly. Moreover, the high mineral filled paper is much easier to dry than normal paper and therefore the machinery can be run more rapidly, e.g. 10–25% more rapidly, which reduces production costs. Furthermore, the amount of steam necessary to dry the paper is reduced, conservatively, at least 15% and, more realistically, as much as 30%.

In addition to the mineral filler, the fine paper is normally made from hardwood and softwood pulps prepared by various conventional pulping processes, as well as the conventional paper-making chemicals such as rosin size, alum and polymeric retention aids. It will be understood, however, that the invention can also be used in the manufacture of synthetic paper. With regard to the wood fibers used, any conventional stock may be used. Desirably, however, the wood fibers in the furnish will be from 50–100% hardwood kraft, with 0–50% softwood kraft, most desirably 25% softwood kraft and 75% hardwood kraft. Calculated on the basis of total solids in the furnish, it is preferred to have 15–30% by weight softwood kraft and 15–50% hardwood kraft.

The paper-making slurry in accordance with the invention is preferably at an acid pH, although an acid paper-making furnish is not essential. Alum and rosin size are preferably but not essentially present, and by term "rosin size" it is intended to encompass dispersed rosin size, synthetic rosin size and rosin derivatives. Other methods of internal sizing can also be used. Polymeric polyacrylamide (such as Accostrength) dry strength additives can also be used in this system to promote additional dry strength and some wet web strength on the paper-making machine.

The preferred furnishes all contain alum and rosin size, preferably in the ratio of approximately 3 parts of alum to one part of rosin size, although it will be understood that these ratios may be varied. Suitable quantities are 5–10 pounds of rosin size per ton of dry furnish, and an amount sufficient of alum, usually about 10–20 and preferably 15 pounds of alum per ton of dry furnish to provide a pH of 4.0–5.0.

An important aspect of the present invention is the use of a suitable latex. The latex can be a styrene-butadiene latex, an acrylic latex, a polyvinyl acetate latex, or another type of latex, but most latices which have been used for wet-end saturation are not necessarily suitable because they will not exhaust onto the fibers and fillers when precipitated. It has been found that the most satisfactory latex is an amphoteric latex which is cationic under the preferred conditions of use, e.g. cationic under acid conditions. Cationic latices may also be used. Even an anionic latex can be used, although it has been found that the anionic latex is less satisfactory. Cationic latex, compared to anionic latex, is easier to use, provides good strength and better retention.

The latex, preferably cationic (positive) under the preferred conditions of use, is of a charge opposite to and less than that of the anionic (negative) paper-making system, and thereby precipitates easily on the negatively charged paper fibers and filler (clay) particles thereby forming a paper floc nucleus which, however, remains anionic because the net charge of the fibers and clay filler is greater than that of the cationic latex. As is known, the normal paper-making slurry has an anionic charge because this is the normal charge of the cellulose fibers. In addition, most mineral fillers, i.e. clays, are also strongly anionic, and this adds to the negative charge of the system. Where the filler used is non-ionic or slightly cationic, precipitation of the latex occurs mostly on the cellulose fibers, but floc formation still occurs with the filler becoming entrained in the floc and thereby attaching to the fiber.

It will be understood that in order to reduce the anionic charge it is desirable to add to the system a cationic polymer. Indeed, in accordance with the preferred embodiment, two cationic polymers, alum (which is also cationic), rosin and latex, are added to the system. It will be understood that when an anionic latex is used, the quantity of cationic polymer used should be sufficient to precipitate the anionic latex.

The floc formed by the precipitated latex can either be anionic or cationic and is dependent upon the amount and charge density of the latex used, the pH of the paper-making system and the materials other than the latex used, e.g. type of fiber, type of filler, the charge density of the anionic materials used, etc. This is so because the quantity of latex used is small compared with amounts used to make paperboard or saturated felt, generally running between only 3 and 7% based on the dry furnish. Nevertheless, in spite of the small amount of latex used, which itself is an economic advantage, the characteristics of the floc formed provide excellent retention on the wire of the paper-making machine. Use of this system, as opposed to a standard wet-end saturation approach, gives better filler retention; and, of course, when filler retention is poor, filler is lost which is difficult to recover. In addition, lost filler tends to build up in the wet-end system which can cause runnability problems. At the 5% by weight latex addition levels and with the addition of cationic polymer, the systems allows approximately 87% total retention in the first pass.

As mineral filler, there can be used almost any material that is not water soluble. Most common paper-making filler materials may be used, e.g. kaolin clay, talc, titanium dioxide, aluminum hydrate, hydrated silica, calcium carbonate, etc., and these fillers are accordingly referred to as being "system compatible". Certain fillers have, however, been found to be undesirable when used by themselves; these include diatomaceous earth. Another filler found less satisfactory than others is porous calcined clay, such as high opaque clay and Ansilex. On the other hand, fillers which have been found particularly desirable are various forms of talc, including Mistron vapor talc which is a high brightness talc, and Yellowstone talc. Calcium carbonate is system compatible only in neutral or basic media, and not in paper-making slurrys below the pH of 7.0, as calcium carbonate reacts at acidic pH to generate carbon dioxide which causes foam problems, and therefore calcium carbonate cannot be used in the standard acidic paper-making system where the pH is between 4 and 5.

A particular blend of fillers has been shown to provide superior results, i.e. the two components of the blend act synergistically to provide improved results, primarily increased strength at given filler contents. Thus a mixture of talc, which is neutral in charge, and kaolin clay, which is strongly anionic, act together synergistically to give a stronger product, it being theorized that the talc particles have a physical affinity for the latex and therefore sequester and absorb the latex and act as nuclei for the flocculation. The talc does not disrupt the fiber bonding as much as the kaolin clay. The blend of kaolin clay and talc may range from 95:5 to 5:95 parts by weight, although the preferred range is 5–75% talc for 95–25% kaolin clay. Calculated on the basis of total solids in the furnish, the preferred filler content is 10–30% talc and 10–30% kaolin clay.

The clay, preferably kaolin clay, ranges in particle size from very fine, e.g. about 0.5 microns, to relatively coarse, e.g. maximum size about 15 microns. A highly suitable clay is Astraplate (Georgia kaolin) which is a kaolin clay composed of thin hexagonal plates, 80–82% of which are finer than 2 microns and only 0.005% of which are retained on a 325 mesh screen. Suitable special kaolin clays are disclosed in U.S. Pat. Nos. 2,904,267; 3,477,809; and 4,030,941. The talc is desirably ground to 325 mesh, although its size also is subject to considerable variation.

The synergistic filler system of talc and kaolin clay can be used in high filler content fine papers containing up to 70% by weight filler. When used with the preferred amphoteric latex system, as described above, or even with the next-preferred cationic latex system, the resultant sheet has excellent strength. Even if anionic latex is used instead of the cationic latex, the system will still have good strength because of the filler synergism, although there are operating problems using the anionic latex because it is more difficult to control the precipitation and insure adequate paper floc strength in an acid furnish with the anionic latex due to its charge compatibility with the other components of the furnish. Another problem with the anionic latex system is that the fillers are normally dispersed in water and the dispersion agents normally used are anionic; as the filler must be flocculated with the cationic polymer, excessive polymer usage is required which creates problems in standard paper-making systems and in the handling of the filler.

With reference to the attached drawing, it is seen that hardwood pulp, broke, softwood pulp and filler are all added to a proportioning box (if plural fillers are used they may be pre-blended together) and the slurry then fed to a funnel where latex and rosin are then added, with the mixture flowing into the machine chest; or the latex and rosin may be added directly to the machine chest. From the machine chest the slurry is pumped to a stuff box and on the way alum and a first cationic polymer, e.g. Dow XD-30440.01, are added. From the stuff box the slurry is diluted with water from the white water system, then pumped to the conventional cleaners and screens. Finally the furnish is pumped to a paper machine head box, and on the way a second cationic polymer, e.g. Betz 1260, which also serves as a retention aid, is added.

With reference to the FIGURE, it will be seen that cationic polymer is added at two different points. These polymers are each added to the furnish in an amount of about 0.25 to 3 pounds per ton of dry furnish, preferably about 0.5 pounds per ton. As the stock leaves the machine chest, e.g. at a solid consistency of about 3%, a first cationic polymer is added to the system, preferably Dow XD-30440.01. This cationic polymer is a high M. W. polyacrylamide polymer of pH 4.6, density of 1.1, solids content of 8% and a bulk viscosity of 15,000–20,000 cps.

After the furnish has left the screens and cleaners and before it reaches the paper machine head box, e.g. head box approach piping, a second cationic polymer, preferably Betz 1260, is added to the furnish normally in an amount of 0.25 to 1 pound per ton based on the dry furnish. The second cationic polymer acts in concert with the other components as indicated above to insure maximum flocculation, and also serves as a conventional retention aid. The Betz 1260 cationic polymer is an extremely high M. W. acrylamide copolymer and is sold as a white, free-flowing, water-soluble powder of density approximately 28 lbs/ft$^3$. It will be understood that the first cationic polymer addition may be at any location upstream of the second cationic polymer addition, the latter of which should be at any location downstream of the first addition, the precise addition points depending on the paper machine system.

As indicated above, selection of a proper latex is an important consideration in the successful operation of the present process in order to achieve maximum strength for a given high load of mineral filler. As indicated above and shown in the FIGURE, the latex is preferably added at the machine chest, most desirably in an amount between 3 and 7% based on the dry furnish. It is presently unknown why some latices work well and others do not, but it is believed that possibly important characteristics include particle size, charge, charge density and glass transition temperature. Successful operation has been carried out with the following three latices, listed in the order of their desirability.

(1) Rhoplex P-57 Amphoteric Acrylic Latex (Rohm and Haas). This acrylic latex is characterized by being non-ionic under neutral conditions, but becoming cationic under acid conditions. It is sold in the form of milky-white liquid of 50% solid content having a density of 8.8 lbs per gallon and a specific gravity of 1.06 and a Brookfield LVF Viscosity at 25° C. (No. 2 Spindle 60 rpm) of 200 CPS.

(2) Dow XD-30288.00 Cationic Latex (Dow Chemical Co.). This is a carboxylated styrene-butadiene latex.

(3) Dow XD-30374.01 Anionic Latex (Dow Chemical Co.). This is a carboxylated styrene-butadiene latex of pH 8.0, solids content of 45–47%, particle size of approximately 1600 Å and a specific gravity of 1.01. It is disclosed in the McReynolds U.S. Pat. No. 4,225,383.

Also satisfactory are a cross-linkable styrene-butadiene latex of 60% styrene and 40% butadiene; and a styrene-butadiene latex of 90% styrene and 10% butadiene.

Other successful latices can, in view of the present disclosure, be determined by routine testing, key requirements of the latex being that it must precipitate on the fibers and filler to exhaustion or near exhaustion, that it provide good retention, and that it give adequate strength at high filler contents to enable offset or gravure printing when used at levels not substantially exceeding 7%. Such routine testing may be carried out using a furnish of 3–7% of the test latex and a 50:50 mixture of clay filler and wood pulp on a Noble and Wood hand-sheet machine or equivalent laboratory paper-former with white water recirculation using a standard screen of 100 mesh, the paper sheet being pressed once through a felted Noble and Wood or equivalent presser, and then contact dried. A suitable ionic latex is capable of exhaustion or near exhaustion if, in the test, the paper sheet leaves the wire without a latex residue being left behind; provides good retention if in such test about 75% or more, preferably at least 88%, of the filler and fiber is retained; and provides good strength if in such test the resultant paper sheet has at least 10%, preferably at least 16%, mullen.

With all the furnish combinations discussed above, treatment on the paper machine at the size press position or later for external treatment, e.g. coating or sizing, is desirable to produce the best results, as is also true in the production of normal paper. The material used at e.g. the size press may be selected from those normally used including starch size or polyvinyl alcohol, polyvinyl acetate, styrene-butadiene latex, acrylic latices, clay, titanium dioxide, calcium carbonate, talc, and other commonly used material in the coating of paper and any combination thereof which provides the proper functional surface for printing or other functional end use. By "starch size" it is intended to encompass unmodified potato starch, tapioca starch, corn starch, anionic starch and derivatives of such starches. A particularly suitable material is ethylated corn starch having a solids content of 8–12%, and one example of such a material is Penford Gum 280 (Penick and Ford) which is an 80 fluidity, 2% substituted hydroxyethyl corn starch. It may be applied at the rate of between 30–200 pounds, preferably 60 to 150 pounds per ton.

The following examples are offered illustratively. As adequate strength is a most important function of the resultant paper, strength is set forth in percent mullen, defined as mullen in pounds per square inch (psi) divided by the weight of the paper at 3300 square feet.

EXAMPLE 1

Two series of runs of hand sheets were prepared in a Noble and Wood sheet machine. The filler system was 50% kaolin clay and 50% talc. Both furnishes contained 5% latex and 0.39 lbs/ton of cationic polymer. The latex in the first furnish was Dow anionic XD-30374.01, and in the second furnish was Rohm & Haas P-57 amphoteric latex, the pH of the furnish being adjusted to 4.5 making the latex cationic.

Retention was good, strength was adequate, and no residue was left on the screen for both series of trials. However, the filler in the resultant paper was more concentrated in the paper made with the cationic latex, thereby indicating a larger and more stable floc.

EXAMPLE 2

Using a Noble and Wood laboratory sheet machine, samples were prepared with a furnish of 55% kaolin clay, 45% wood pulp comprising a mixture of 75% hardwood and 25% softwood, 5% Dow XD-30374.01 anionic latex, 0.3 lbs/ton of Dow cationic polymer XD-30440.01, 2.5 lbs/ton of dispersed rosin size (Neuphor 100), and 10 lbs/ton of alum.

The quantity of filler retained was 88%, and the quantity of clay in the paper sheet was 48.9%. The strength of the paper was 10.9% mullen.

EXAMPLE 3

Example 2 was repeated except that the anionic latex of Example 2 was replaced with Rhoplex P-57 amphoteric acrylic latex, the pH of the system being on the acid side so that the latex was in effect cationic. All other variables were maintained the same as in Example 2. The quantity of filler retained was 89.6% and the quantity of clay in the paper product was 49.3%. The strength of the paper was 16.6% mullen.

A comparison between Examples 2 and 3 demonstrate the difference in percent mullen at approximately the same filler content. These examples indicate that cationic latex produces a significantly stronger sheet, expressed in percent mullen, than the anionic latex.

EXAMPLE 4

A pilot paper machine trial was conducted on a standard Fourdrinier machine used for testing purposes (the machine is smaller in width and slower in speed than a normal fine paper machine). The furnish comprised 46% wood pulp, 54% acid flocced kaolin coating clay, 0.5 lbs/ton of Dow XD-30440.01 cationic polymer, 12 lbs/ton of alum, and 5 lbs/ton of dispersed rosin size (Neuphor 100), in addition to 5% of Dow XD-30374.01 anionic latex. The resultant paper of basis weight 83 lbs/3300 $ft^2$ was size press treated at about 100–120 lbs/ton with ethylated corn starch.

First pass retention was 73.9%, the resultant paper having a filler content of 44.7% and a strength of 21.7% mullen. The total ash retention efficiency was 66.2%.

EXAMPLE 5

Example 4 was repeated to make paper at a basis weight of 47.3 lbs compared with the Example 4 basis weight of 83 lbs. The total ash retention efficiency was 61.3% with first pass retention of 64.5%. The resultant paper contained 41.4% of the clay filler and had a strength of 14.8% mullen.

EXAMPLE 6

Example 4 was repeated using the same furnish, except that the anionic styrene-butadiene latex was replaced by Dow XD-30288.00 cationic carboxylated styrene-butadiene latex, used at the same rate of 5% based on the total dry solids of clay and wood fiber. The total ash retention efficiency was 68.2% and the first pass retention was 81.4%. The resultant paper sheet contained 47% filler and had a strength of 19% mullen. Comparing Example 6 with Examples 4 and 5, it is seen that the cationic latex gives better retention and is easier to use than the anionic latex. In addition, the Example 6 paper is stronger than the paper of Example 5.

EXAMPLE 7

Example 6 was repeated except that the Dow cationic latex was replaced with an equal amount of Rhoplex P-57 amphoteric acrylic latex. The total ash retention efficiency was 83.1% and the first pass retention was 81.6%. The resultant paper sheet contained 49.2% filler and had a strength of 19.6% mullen.

The process of Example 7 was carried out at an acidic pH so that the amphoteric latex was actually cationic. Comparing Example 7 to Example 4, it is seen that the quantity of filler retained in Example 7 was higher, and the strength was only slightly lower. Compared with Example 5, both the retention and strength was improved. Examples 4–7 demonstrate the higher first pass retentions and ash efficiencies of the cationic and amphoteric latices, thereby indicating that these latices work better in the acid paper-making process.

EXAMPLE 8

Using the pilot Fourdrinier machine, paper was formed from a furnish comprising 50% wood pulp, 50% coating grade kaolin clay, 5% Dow XD-30374.01 anionic carboxylated styrene-butadiene latex, 5 lbs/ton of Neuphor 100 and 12 lbs/ton of alum. The ash efficiency was 74.9% and the first pass retention was 74.5%. The paper was not sized externally. The resultant paper contained 42.8% filler and had a strength of 15.3% mullen.

EXAMPLE 9

Example 8 was repeated except that the quantity of paper pulp in the furnish was reduced to 46% and the quantity of coating grade kaolin clay was increased to 54%, and also the latex used was Rhoplex P-57 amphoteric acrylic latex, cationic under the conditions of use. The ash efficiency was 73.19% and the first pass retention was 76.7%. The resultant product contained 46.6% filler and had a strength of 13.5% mullen.

EXAMPLE 10

Example 8 was repeated except that the relative quantities of kaolin clay and wood pulp were adjusted to provide 55% clay and 45% wood pulp. The ash efficiency was 66% and the first pass retention was 66.1%. The resultant product contained 44.7% filler and had a strength of only 9.8% mullen.

Examples 8–10 demonstrate that while the anionic latex approaches the cationic latex in efficiency when the furnish contains no more than about 50% filler, its efficiency drops off considerably, particularly relative to the strength of the product, when the quantity of filler in the slurry reaches 55%.

EXAMPLE 11

Using the pilot paper machine, paper was made from a furnish comprising 46% wood pulp and 54% filler, of which 50% was talc and 50% clay. Also present in the furnish was 5% Dow XD-30374.01 anionic carboxylated styrene-butadiene latex, 5 lbs/ton of Neuphor 100 rosin, 12 lbs/ton of alum and 0.5 lbs/ton of Dow XD-30440.01 cationic polyacrylamide. The ash efficiency was 73.9% and the first pass retention was 79.5%.

The resultant paper was size press treated with starch. It had a filler content of 50.9% and a strength of 20.9% mullen.

EXAMPLE 12

Example 11 was repeated except that the filler comprised 46% talc and 54% clay. The basis weight of the paper produced was 48.8 lbs/3300 $ft^2$. The ash efficiency was 67.8% and the first pass retention 83.6%. The resultant paper contained 46.9% filler and had a strength of 20% mullen.

EXAMPLE 13

Example 12 was repeated except that the 5% anionic styrene-butadiene latex was replaced with 5% Rhoplex P-57 amphoteric acrylic latex. The ash efficiency was 78.2% and the first pass retention was 87.9%. The product contained 49.3% filler and had a strength of 22.1% mullen.

A comparison between Examples 13 and 12 again shows the superiority of the amphoteric acrylic latex, cationic in use, compared with the anionic latex, other variables remaining constant.

EXAMPLE 14

Example 13 was repeated except that the quantity of filler was increased to 54%, and the relative quantities of talc and clay were changed to provide 21.5% talc and 78.5% clay. The ash efficiency was 72.6% and the first pass retention 87.8%. The resultant paper contained 50.9% filler and had a strength of 17.1% mullen.

Comparing Example 14 to Example 13, it is seen that the strength is reduced, although the retention remains very high.

EXAMPLE 15

Example 12 was repeated except that the basis weight of the paper produced was 96.8 lbs/3300 ft$^2$, approximately double the weight of the paper of Example 12. The ash efficiency was 83.4% and the first pass retention was 83.6%. The resultant paper contained 49.8% filler and had a strength of 26.5% mullen.

A comparison of Examples 15 and 12 shows that an increase in basis weight, all other factors remaining constant, provides a significant increase in strength for high filler content, fine paper containing a mixture of talc and clay as the filler. Examples 11–15 demonstrate the synergism of the combination of clay and talc, these examples showing that talc at the 50% level is synergistic using all satisfactory latex systems, but is particularly effective with the amphoteric latex where it produces a stronger composite paper.

EXAMPLE 16

Paper sheets of Examples 4, 7 and 14 were printed on a full size Mhiele 1000, four-color offset press, with no problems, with inks designed for coated paper. All of these papers had sufficient strength to withstand the printing process, the press running at 600 ft/min.

EXAMPLE 17

A comparative test was conducted to determine the economics of producing fine paper according to the present invention. Four paper furnishes were prepared from which paper was formed.

The first furnish, the blank or comparative test, comprised 90% wood fiber (75% hardwood, 25% softwood), 12 lbs/ton alum, 5 lbs/ton of rosin and 10% kaolin clay.

Samples 1, 2 and 3 in accordance with the invention comprised similar furnishes except that each of these samples contained 5% of Rhoplex P-57 amphoteric acrylic latex, as well as increased amounts of kaolin clay, Sample 1 comprising 40% clay, Sample 2 comprising 50% clay, and Sample 3 comprising 60% clay.

The four samples were dried to a 5% moisture level at the reel. The results are shown in Table I below:

TABLE I

| | | Laboratory Dryness Evaluation - Based on 5% Moisture at the Reel | | | | | |
|---|---|---|---|---|---|---|---|
| Sample | Filler in Furnish | % Filler in Paper | % Dryness | Lbs. Steam to Dry to 5% Moisture | Lbs. Steam Saved Compared to Blank | Cost Saving | % Production Increase |
| Blank | 10% | 6.70% | 29.34% | 5370 lbs. | | | |
| 1 | 40% | 41.24% | 37.39% | 3698 lbs. | 1672 lbs. | $4.18 | 31.1% |
| 2 | 50% | 48.45% | 38.45% | 3530 lbs. | 1840 lbs. | $4.60 | 34.3% |
| 3 | 60% | 59.16% | 40.36% | 3249 lbs. | 2121 lbs. | $5.30 | 39.5% |

As shown in the table above, the comparative paper containing 10% clay and no latex after pressing had a dryness of 29.34% while an identically formed and pressed 60% clay and 5% latex paper had a 40.36% dryness after pressing. Consequently, the high filler paper required far less steam heat to dry to a 5% moisture level, and consequently there resulted an important energy savings as indicated in the table. Also, because less drying is required, the production speed is increased as shown.

EXAMPLE 18

A series of hand sheet comparisons were made using different latices and different filler contents. All furnishes were the same except for the differences shown in Tables II and III, which tables also give the comparative results.

TABLE II

| | | | | Clay/Talc Series | | | | | | | |
|---|---|---|---|---|---|---|---|---|---|---|---|
| Latex | Target % Filler | Basis Wt. lbs/3300 ft$^2$ Product | Caliper Mils | Caliper/ wt. | Mullen psi | % Mullen | gms Elmendorf Tear | Scott Bond Units | % Ash | Actual % Filler | % Filler Retention |
| BLANK (no latex) | 20 | 60.2 | 7.4 | 1.23 | 14.0 | 23.26 | 64 | 84 | 16.5 | 18.3 | .92 |
| Cross-linkable | | | | | | | | | | | |
| 60% styrene-40% butadiene* | 20 | 57.7 | 6.9 | 1.20 | 18.0 | 31.2 | 74 | 134 | 17.6 | 19.5 | .98 |
| 90% styrene-40% butadiene** | 20 | 59.1 | 7.1 | 1.20 | 18.2 | 30.8 | 76 | 108 | 15.3 | 17.0 | .85 |
| P-57 | 20 | 55.0 | 6.5 | 1.18 | 21.3 | 38.7 | 60 | 162 | 16.0 | 17.8 | .89 |
| BLANK (no latex) | 30 | 60.4 | 7.3 | 1.21 | 7.7 | 12.75 | 48 | 50 | 24.5 | 27.2 | .91 |
| Cross-linkable | | | | | | | | | | | |
| 60% styrene-40% butadiene | 30 | 57.3 | 6.8 | 1.19 | 14.3 | 25.0 | 62 | 141 | 25.5 | 28.3 | .94 |
| 90% styrene-40% butadiene | 30 | 55.6 | 6.7 | 1.21 | 12.7 | 22.8 | 58 | 87 | 21.4 | 23.8 | .79 |
| P-57 | 30 | 50.1 | 6.3 | 1.26 | 15.4 | 30.7 | 48 | 136 | 21.9 | 24.3 | .81 |
| BLANK (no latex) | 40 | 57.5 | 7.2 | 1.25 | 4.2 | 7.3 | 30 | 40 | 32.4 | 36.0 | .90 |
| latex (i) | 40 | 56.8 | 6.6 | 1.16 | 10.2 | 18.0 | 44 | 85 | 31.7 | 35.2 | .88 |
| latex (ii) | 40 | 50.6 | 6.3 | 1.25 | 8.0 | 15.8 | 44 | 80 | 28.5 | 31.6 | .79 |
| P-57 | 40 | 48.5 | 6.1 | 1.26 | 10.7 | 22.1 | 42 | 114 | 27.9 | 31.0 | .78 |
| BLANK (no latex) | 50 | 52.6 | 6.7 | 1.27 | 2.3 | 4.37 | 24 | 32 | 35.9 | 39.9 | .80 |
| latex (i) | 50 | 55.9 | 6.9 | 1.23 | 8.0 | 14.3 | 42 | 101 | 39.7 | 44.1 | .88 |
| latex (ii) | 50 | 46.7 | 6.0 | 1.29 | 4.7 | 10.1 | 34 | 63 | 34.9 | 38.7 | .77 |
| P-57 | 50 | 44.8 | 5.8 | 1.30 | 7.1 | 15.9 | 28 | 91 | 35.4 | 39.3 | .79 |

*latex (i)
**latex (ii)

TABLE III

| Latex | Target % Filler | Basis Wt. lbs/3300 ft$^2$ Product | Caliper Mils | Caliper/ wt. | Mullen psi | % Mullen | gms Elmendorf Tear | Scott Bond Units | % Ash | Actual % Filler | % Filler Retention |
|---|---|---|---|---|---|---|---|---|---|---|---|
| | | | | Clay Series | | | | | | | |
| BLANK (no latex) | 20 | 60.2 | 7.7 | 1.28 | 10.6 | 17.61 | 72 | 62 | 15.5 | 17.5 | .88 |
| latex (i) | 20 | 62.6 | 7.2 | 1.15 | 20.1 | 32.1 | 84 | 126 | 15.4 | 17.4 | .87 |
| latex (ii) | 20 | 61.7 | 7.4 | 1.20 | 16.0 | 25.9 | 78 | 81 | 13.9 | 15.7 | .79 |
| P-57 | 20 | 59.1 | 6.9 | 1.17 | 18.7 | 31.6 | 50 | 140 | 15.7 | 17.7 | .89 |
| BLANK (no latex) | 30 | 58.7 | 7.3 | 1.24 | 6.1 | 10.39 | 46 | 42 | 21.9 | 24.8 | .83 |
| latex (i) | 30 | 61.2 | 7.0 | 1.14 | 17.0 | 27.8 | 74 | 113 | 21.9 | 24.8 | .83 |
| latex (ii) | 30 | 58.5 | 7.0 | 1.20 | 12.4 | 21.2 | 64 | 70 | 20.2 | 22.8 | .76 |
| P-57 | 30 | 55.4 | 6.5 | 1.17 | 12.3 | 22.2 | 62 | 95 | 22.4 | 25.3 | .84 |
| BLANK (no latex) | 40 | 56.5 | 6.9 | 1.22 | 2.95 | 5.22 | 32 | 35 | 29.9 | 33.8 | .85 |
| latex (i) | 40 | 57.2 | 6.6 | 1.15 | 13.1 | 22.9 | 58 | 108 | 29.3 | 33.1 | .83 |
| latex (ii) | 40 | 56.1 | 6.9 | 1.23 | 8.2 | 14.6 | 50 | 58 | 25.0 | 28.8 | .72 |
| P-57 | 40 | 50.3 | 6.3 | 1.25 | 9.5 | 18.9 | 46 | 93 | 26.1 | 29.5 | .74 |
| BLANK (no latex) | 50 | 48.4 | 6.3 | 1.30 | 1.1 | 2.27 | 18 | 29 | 32.3 | 36.5 | .73 |
| latex (i) | 50 | 56.9 | 6.3 | 1.11 | 8.0 | 14.1 | 44 | 101 | 36.9 | 41.7 | .83 |
| latex (ii) | 50 | 50.7 | 6.2 | 1.22 | 5.2 | 10.3 | 42 | 54 | 30.7 | 34.7 | .69 |
| P-57 | 50 | 44.7 | 5.7 | 1.28 | 6.1 | 13.7 | 34 | 80 | 30.3 | 34.2 | .68 |

EXAMPLE 19

To compare the process U.K. Pat. No. 1,505,641 with the present invention, a series of comparative tests were carried out. Consistent with Example 1 of the U.K. patent, the furnish comprised 50 parts of cellulose fibers, 48 parts of filler and 5% latex, based on the total quantity of cellulose fibers and filler. In the trials according to the U.K. patent, the filler was calcium carbonate and such calcium carbonate was pretreated with the latex. In the trials according to the invention, the filler was clay or an equal mixture of clay and talc. Where an anionic latex was used it was Dow XD-30374.01 carboxylated styrene-butadiene anionic latex. Where the latex was cationic, it was Rhoplex P-57. The paper was formed on a laboratory hand-former. The results are given below in Table IV.

TABLE IV

| Filler | Latex | pH | Basis Wt. lbs/3300 ft$^2$ | Actual % Filler | % Mullen | % Filler Retention |
|---|---|---|---|---|---|---|
| U.K. Patent 1505641 | Anionic | 7.5 | 42.8 | 39.1 | 8.2 | 81.5 |
| U.K. Patent 1505641 | Anionic | 5.5 | 43.8 | 31.1 | 10.2 | 64.8 |
| Clay | Anionic | 4.6 | 53.2 | 41.5 | 12.5 | 86.5 |
| Clay Talc 1:1 | Anionic | 4.7 | 53.1 | 39.9 | 8.5 | 83.1 |
| Clay | Cationic | 4.8 | 52.5 | 41.0 | 13.3 | 85.4 |
| Clay Talc 1:1 | Cationic | 4.6 | 51.6 | 40.9 | 14.0 | 85.2 |

From the second trial given in Table IV above, it is clear that the system of the U.K. patent is not suitable for use at an acid pH, as the latex did not adequately protect the calcium carbonate which, to some extent, reacted with the acid and caused foaming; 8% of the filler was lost due to reaction with the alum and it can be seen that the calcium carbonate buffered the system to a pH of 5.5. In the trials carried out in an acid pH the target pH was 4.5, achieved by the addition of alum.

The strength of the hand sheets made using the cationic amphoteric latex exceeded the strength obtained by the U.K. patent system at the selected filler level. The U.K. patent system at alkaline pH 7.5 retained 39.1% filler with an 8.2% mullen. The cationic amphoteric latex system with clay and talc retained 40.9% filler with a 14% mullen, and thus was superior to the U.K. system.

EXAMPLE 20

A series of runs were made on a full-size Fourdrinier paper-making machine. The furnish to the machine consisted of 50% wood fiber, 25% kaolin clay (Kaopaque 10) and 25% Yellowstone talc, the fiber constituting 35–40% hardwood kraft and 10–15% softwood kraft based on the total solid content of the furnish. Amphoteric latex P-57 was added at the machine chest in an amount of 4.4% based on the total solids in the furnish. Rosin size was also added in the machine chest at the rate of 7.6 lbs/ton. Alum at the rate of 20 lbs/ton and Dow XD-30440.01 at the rate of 3.2 lbs/ton were added at the suction side of the machine chest pump. Betz 1260 cationic polymer was added prior to the machine head box at the rate of about 0.4 lbs/ton. After paper formation, a size of 10% solids Penford Gum 280 was applied at the size press at a pickup rate of 111–117 lbs/ton. The machine speed was 600 ft/min with a production rate of 4.5–5.0 tons/hr.

Table V shows the average results on the eight runs conducted. Table VI shows the average results on the eight runs conducted after sizing. Table VI shows the average base sheet results.

Results were generally excellent, with very high strength at 40% filler levels. First pass retention levels ranged from 60–80%. The sheets were easily dried, allowing an increase in the production rate. Several rolls were printed successfully with no noticeable buildup on the printing presses.

The tensile properties of the papers so produced are shown in Table VII.

TABLE V

AVERAGE RESULTS AFTER SIZING

| | Sets 201-205 | Sets 206-208 |
|---|---|---|
| Basis Weight in lbs/3300 ft$^2$ | 75.9 | 76.7 |
| Moisture % | 3.6 | 3.1 |
| Caliper in mils | 6.0 | 5.3 |
| Smoothness (Sheffield units) | | |
| FS (felt side) | 239 | 136 |
| WS (wire side) | 267 | 156 |
| Gurley Density (seconds/100 ml. air passage) | 8.8 | 15.0 |
| Mullen (psi) | 24.2 | 22.7 |
| GE Brightness | 82.9 | 82.9 |
| % Opacity | 95.9 | 96.1 |
| % Ash | 34.7 | 36.7 |
| Scott Bond ($10^{-3}$ ft-lbs) | 128 | 126 |
| Taber Stiffness | 3.36 | 3.40 |
| Bulk/Weight Ratio | 0.79 | 0.69 |
| % Mullen | 31.9 | 29.6 |
| % Filler | 38.5 | 40.5 |

TABLE VI

AVERAGE BASE SHEET RESULTS

| | |
|---|---|
| Basis Weight in lbs/3300 ft$^2$ | 75.2 |
| Caliper in mils | 7.5 |
| B/W Ratio | 1.00 |
| Smoothness (Sheffield units) | |
| FS | 340 |
| WS | 357 |
| Gurley Density (seconds/100 ml. air passage) | 9 |
| Muilen (psi) | 12.9 |
| % Mullen | 17.2 |
| GE Brightness | 83.4 |
| % Opacity | 97.1 |
| % Ash | 39.6 |

TABLE VI-continued

AVERAGE BASE SHEET RESULTS

| | |
|---|---|
| % Filler | 43.9 |
| Scott Bond ($10^{-3}$ ft-lbs) | 63 |
| Taber Stiffness | 3.16 |

NOTE:
Sample taken before size press at the end of the trial.

TABLE VII

| | | | | TENSILE PROPERTIES | | | | | | |
|---|---|---|---|---|---|---|---|---|---|---|
| Set | Basis Weight (lb/3300 ft$^2$) | % Filler | Caliper (in) | Peak Load (lb) | Peak Elongation (in) | % Strain | Breaking Length (km) | Tensile Strength (lb/in$^2$) | Tensile Energy (ft-lb) | TEA (ft-lb) ft$^2$ |
| 201 | 59.6 | 19.8 | .00511 | 31.97 | .0621 | 2.24 | 1.270 | $6.26 \times 10^3$ | 0.1080 | 5.65 |
| 202 | 74.4 | 34.0 | .00578 | 29.75 | .0523 | 1.89 | 0.835 | $5.15 \times 10^3$ | 0.0873 | 4.56 |
| 203 | 77.2 | 38.2 | .00585 | 27.31 | .0479 | 1.73 | 0.730 | $4.67 \times 10^3$ | 0.0743 | 3.83 |
| 204 | 79.1 | 44.7 | .00603 | 23.63 | .0496 | 1.79 | 0.598 | $3.92 \times 10^3$ | 0.0682 | 3.56 |
| 205 | 81.1 | 45.8 | .00563 | 25.15 | .0440 | 1.59 | 0.665 | $4.47 \times 10^3$ | 0.0630 | 3.29 |
| 206 | 62.9 | 38.4 | .00444 | 20.51 | .0465 | 1.64 | 0.887 | $4.62 \times 10^3$ | 0.0549 | 2.87 |
| 207 | 78.6 | 44.8 | .00491 | 25.17 | .0502 | 1.81 | 0.787 | $5.13 \times 10^3$ | 0.0716 | 3.74 |
| 208 | 75.3 | 41.6 | .00491 | 27.85 | .0517 | 1.86 | 0.909 | $5.67 \times 10^3$ | 0.0817 | 4.27 |
| PenWeb Offset | 66.9 | 16.0 | .00539 | 34.00 | .0423 | 1.52 | 1.138 | $6.31 \times 10^3$ | 0.0800 | 4.18 |

EXAMPLE 21

Using the same machine as used in Example 20, a series of runs were conducted to make 60 lb, 50 lb, and 45 lb paper containing 32–42% filler. Essentially the same procedure was followed as in Example 20, although relatively larger quantities of softwood in relation to hardwood were used in the production of the 50 lb and 60 lb paper. Once again, results were excellent, with the paper drying rapidly and having excellent printability. Results are shown in Tables VIII through XI.

TABLE VIII

AVERAGE TEST RESULTS

| | Set # 534-544 | Set # 545-547 | Set # 548-551 | Set # 552 |
|---|---|---|---|---|
| Basis Weight | 58.6 | 56.4 | 50.6 | 45.7 |
| Moisture % | 3.7 | 4.2 | 3.0 | — |
| Caliper | 4.2 | 3.7 | 3.4 | 3.9 |
| Smoothness FS | 130 | 125 | 115 | 105 |
| WS | 145 | 140 | 135 | 125 |
| Gurley Density | 11 | 13 | 12 | 9 |
| Mullen (psi) | 23.2 | 17.5 | 16.2 | 18.0 |
| % Mullen | 39.6 | 31.0 | 32.1 | 39.4 |
| Brightness | 82.6 | 83.2 | 83.3 | 82.3 |
| % Opacity | 93.0 | 93.6 | 91.5 | 89.5 |
| % Ash | 28.6 | 35.7 | 36.0 | 33.6 |
| % Filler | 31.7 | 39.6 | 40.0 | 37.3 |
| Scott Bond ($10^{-3}$ ft-lbs) | 110 | 98 | 107 | 150 |
| Taber Stiffness | 1.82 | 1.50 | 1.09 | 0.75 |
| Bulk/Weight Ratio | 0.72 | 0.66 | 0.66 | 0.68 |

TABLE IX

| | DRY END CONDITIONS | | | | | | | | | | | | |
|---|---|---|---|---|---|---|---|---|---|---|---|---|---|
| | Set 543 | Set 544 | Set 545 | Set 546 | Set 547 | Set 548 | Set 549 | Set 550 | Set 551 | Set 552 | Common Offset Paper | | |
| Basis Weight | 58.0 | 59.3 | 57.6 | 56.4 | 55.3 | 50.8 | 50.7 | 50.5 | 50.5 | 45.7 | 60 | 50 | 40 |
| Speed (fpm) | 800 | 825 | 825 | 900 | 900 | 900 | 900 | 900 | 900 | 900 | 725 | 775 | — |
| Production (tons/hr) | 4.92 | 5.19 | 5.04 | 5.38 | 5.28 | 4.85 | 4.85 | 4.85 | 4.85 | 4.36 | 3.83 | 3.83 | 3.75 |
| Dryer Steam Pressure: | | | | | | | | | | | | | |
| Main Section (psi) | 13.5 | 16.0 | 16.0 | 14.5 | 13.5 | 10.5 | 10.5 | 10.5 | 10.5 | 9.0 | 20 | 20 | 20 |
| After Section (psi) | 21.0 | 24.0 | 18.0 | 20.5 | 19.0 | 15.0 | 15.0 | 16.0 | 17.0 | 17.0 | 30 | 30 | 30 |

TABLE X

| I.G.T. PRINTING TEST RESULTS Westvaco Rod Applicator: #7 Ink; A-spring tension; 50 kg pressure | | |
|---|---|---|
| Set # | Felt Side (fpm) | Wire side (fpm) |
| 543 | 190 | 400 |
| 544 | 190 | 420 |
| 545 | 110 | 290 |
| 546 | 90 | 260 |
| 547 | 100 | 290 |
| 548 | 110 | 340 |
| 549 | 130 | 330 |
| 550 | 130 | 310 |
| 551 | 90 | 310 |
| 552 | 190 | 420 |

NOTE: 420 denotes no picking

TABLE XI

| MATERIAL ANALYSIS | | | | | | |
|---|---|---|---|---|---|---|
| Set # | % Hardwood | % Softwood | % Latex | % Starch | % Moisture | % Filler |
| 543 | 38.1 | 15.5 | 3.9 | 7.7 | 3.7 | 31.1 |
| 544 | 39.6 | 13.2 | 3.9 | 7.3 | 3.7 | 32.3 |
| 545 | 28.6 | 12.8 | 4.1 | 7.6 | 4.2 | 42.7 |
| 546 | 29.0 | 18.5 | 4.1 | 7.0 | 4.2 | 37.2 |
| 547 | 22.9 | 22.8 | 4.1 | 7.2 | 4.2 | 38.8 |
| 548 | 26.8 | 17.8 | 4.6 | 7.8 | 3.0 | 40.0 |
| 549 | 27.5 | 17.6 | 4.6 | 7.8 | 3.0 | 39.5 |
| 550 | 27.0 | 18.7 | 3.0 | 7.8 | 3.0 | 40.5 |
| 551 | 24.0 | 22.2 | 3.0 | 7.8 | 3.0 | 40.0 |
| 552 | 32.7 | 15.4 | 3.3 | 8.3 | 3.0 | 37.3 |

It will be obvious to those skilled in the art that various changes may be made without departing from the scope of the invention and the invention is not to be considered limited to what is shown in the drawings and described in the specification.

What is claimed is:

1. A method of manufacturing fine paper containing mineral filler at a high speed comprising:

preparing an acidic paper furnish including papermaking fibers; an amount sufficient of mineral filler to retain internally in the fine paper web formed of 30–70% mineral filler, and wherein said mineral filler is system compatible; at least one retention aid agent which comprises a water soluble cationic polymer; and 3–7%, based on the dry furnish, of a cationic latex or amphoteric latex which is cationic at acid pH, said cationic or amphoteric latex being selected from latices which provide good mineral filler retention without substantial reduction in strength, which have a charge opposite to and less than the sum of the charges of the other ingredients of said furnish, and which precipitate on the fibers and fillers to exhaustion or near exhaustion;

forming a wet paper web from said furnish such as to produce fine paper of thickness 1.5–15 mils and weight 30–150 lbs/3300 $ft^2$ containing internally greater than 30% mineral filler up to 70% mineral filler, and having tensile and Z-directional strength sufficient to withstand high-speed offset or gravure printing;

drying said web; and surface treating the dried web to improve the printability thereof.

2. A method according to claim 1 wherein said wet paper web is formed on a Fourdrinier paper machine.

3. A method according to claim 1 wherein said furnish also comprises alum.

4. A method according to claim 3 wherein said furnish comprises approximately 5–10 lbs of rosin size per ton of dry furnish and sufficient of said alum to provide a pH of 4.0–5.0.

5. A method according to claim 1 wherein said papermaking fibers are cellulose fibers and comprise 50–100% hardwood kraft and 0–50% softwood kraft.

6. A method according to claim 5 wherein said cellulose fibers comprise approximately 25% softwood kraft and 75% hardwood kraft.

7. A method according to claim 1 wherein said latex is selected from styrene-butadiene latex, acrylic latex, and polyvinyl acetate latex.

8. A method according to claim 1 wherein said latex is amphoteric at a pH of 7.0, and is cationic under acidic conditions.

9. A method according to claim 1 wherein said retention aid agent comprises two said cationic polymers, each of which is added to the furnish at a different stage during the preparation of said furnish.

10. A method according to claim 1 wherein said mineral filler is selected from the group consisting of kaolin clay, talc, titanium dioxide, aluminum hydrate, hydrated silica and mixtures thereof.

11. A method according to claim 1 wherein said filler comprises a mixture of talc and kaolin clay.

12. A method according to claim 11 wherein said mixture of kaolin clay and talc is in the ratio of 95:5 to 5:95 parts by weight.

13. A method according to claim 11 wherein said mixture comprises 5–75% talc and 95–25% kaolin clay.

14. A method according to claim 10 or 11 or 12 or 13 wherein the particle size of said filler ranges from 0.5 to 15 microns.

15. A method according to claim 1 wherein said preparation of the paper furnish comprises mixing hardwood pulp, broke, softwood pulp and filler, feeding the resultant slurry to a funnel where latex and rosin are added, passing the resultant mixture into a machine chest, adding alum and a first cationic polymer, adding dilution water, and adding a second cationic polymer.

16. A method according to claim 15 wherein each of said cationic polymers is added in an amount of about 0.25 to 3 lbs per ton of dry furnish.

17. A method according to claim 1 wherein said surface treating of the dried web comprises surface sizing of the dried web comprising coating the dried web with starch size at the rate of 30–200 lbs of said starch size per ton of paper.

18. Method according to claim 1 wherein said surface treating of the dried web comprises coating the dried web with starch, polyvinyl alcohol, styrene-butadiene latex, polyvinyl acetate latex, clay, titanium, calcium carbonate, talc, or any combination thereof to improve the surface of printing or other functional end use.

19. Method according to claim 1 wherein the thickness of the said paper ranges from 2.0–8.0 mils.

20. Method according to claim 1 wherein said papermaking fibers are cellulose fibers comprised of bleached and unbleached hardwood and softwood fibers pulped by various pulping methods, i.e. groundwood, sulfite and kraft pulping including thermomechanical, semichemical and soda pulping process.

21. Method according to claim 1 wherein said papermaking fibers contain 1–100% synthetic fibers.

22. A method according to claim 1 wherein said fine paper produced has a filler content no greater than 50% by weight.

23. Fine paper of 2–13 mils thickness produced according to the method of claim 1 and containing about 40% mineral filler for a basis weight of about 40 lbs/3300 $ft^2$, about 50% mineral filler for a basis weight of about 50 lbs/3300 $ft^2$, about 60% mineral filler for a basis weight of about 60 lbs/3300 $ft^2$, or about 70% mineral filler for a basis weight of about 70–150 lbs/3300 $ft^2$.

24. Fine paper of 3–10 mils thickness having sufficient tensile and Z-directional strength to withstand high-speed offset or gravure printing, of weight 30–150 lbs/3300 $ft^2$, containing 30–70% mineral filler, produced according to the method of claim 1.

25. Fine paper of 3–10 mils thickness having sufficient tensile and Z-directional strength to withstand high-speed offset or gravure printing, of weight 30–150 lbs/3300 $ft^2$, containing 30–70% mineral filler, produced according to the method of claim 14.

26. Fine paper according to claim 23 having a filler content no greater than 50% by weight.

27. Fine paper according to claim 25 or 26 wherein said filler has a particle size no greater than about 325 mesh.

28. Fine paper of 2–13 mils thickness produced according to the method of claim 3 and containing about 40% mineral filler for a basis weight of about 40 lbs/3300 $ft^2$, about 50% mineral filler for a basis weight of about 50 lbs/3300 $ft^2$, about 60% mineral filler for a basis weight of about 60 lbs/3300 $ft^2$, or about 70% mineral filler for a basis weight of about 70–150 lbs/3300 $ft^2$, said fine paper having sufficient tensile and Z-directional strength to withstand high-speed offset or gravure printing.

* * * * *